US008689382B2

(12) United States Patent
Hooper et al.

(10) Patent No.: US 8,689,382 B2
(45) Date of Patent: Apr. 8, 2014

(54) METHOD OF MANUFACTURING AN ARTICLE OF FOOTWEAR INCLUDING A COMPOSITE UPPER

(71) Applicant: Nike, Inc., Beaverton, OR (US)

(72) Inventors: Paul Hooper, Vancouver, WA (US); Peter A. Hudson, Portland, OR (US); Fabio Marniga, Treviso (IT)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 13/895,457

(22) Filed: May 16, 2013

(65) Prior Publication Data

US 2013/0318726 A1 Dec. 5, 2013

Related U.S. Application Data

(60) Division of application No. 13/018,596, filed on Feb. 1, 2011, now Pat. No. 8,464,440, which is a continuation of application No. 11/854,832, filed on Sep. 13, 2007, now Pat. No. 7,941,942.

(51) Int. Cl.
*A43B 23/02* (2006.01)

(52) U.S. Cl.
USPC ..... 12/142 P; 12/146 C; 36/45

(58) Field of Classification Search
USPC ..... 12/142 P, 146 C, 142 F; 36/45, 109, 55
See application file for complete search history.

(56) References Cited

U.S. PATENT DOCUMENTS

| | | | | |
|---|---|---|---|---|
| 2,034,091 | A * | 3/1936 | Dunbar | 36/4 |
| 2,050,751 | A * | 8/1936 | Enos | 36/55 |
| 4,069,602 | A | 1/1978 | Kremer et al. | |
| 4,526,828 | A * | 7/1985 | Fogt et al. | 442/19 |
| 4,735,003 | A | 4/1988 | Dykeman | |
| 5,765,297 | A | 6/1998 | Cooper et al. | |
| 5,878,512 | A | 3/1999 | Cooper et al. | |
| 5,979,081 | A * | 11/1999 | Vaz | 36/107 |
| 6,003,247 | A | 12/1999 | Steffe | |
| 6,151,804 | A | 11/2000 | Hieblinger | |
| 6,558,784 | B1 | 5/2003 | Norton et al. | |
| 6,986,183 | B2 * | 1/2006 | Delgorgue et al. | 12/146 C |
| 7,040,042 | B2 * | 5/2006 | Light | 36/117.1 |
| 7,140,127 | B2 | 11/2006 | Yang | |

(Continued)

FOREIGN PATENT DOCUMENTS

| | | |
|---|---|---|
| CN | 2847918 | 12/2006 |
| DE | 102005026837 | 8/2006 |

(Continued)

OTHER PUBLICATIONS

The International Search Report and Written Opinion mailed Dec. 7, 2008 in International Application No. PCT/US2008/075975.

(Continued)

*Primary Examiner* — Ted Kavanaugh
(74) *Attorney, Agent, or Firm* — Plumsea Law Group, LLC

(57) ABSTRACT

A method of manufacturing an upper made of a composite material for an article of footwear is disclosed. The method includes associating a layer of carbon fiber material and a flexible substrate to form the composite material. A thin outer coating of TPU is applied to an outer surface of the carbon fiber material of the composite material. The method forms an article of footwear having an upper that is generally flexible and lightweight.

20 Claims, 7 Drawing Sheets

(56) References Cited

U.S. PATENT DOCUMENTS

| | | | | |
|---|---|---|---|---|
| 7,832,117 | B2 | 11/2010 | Auger et al. | |
| 7,941,942 | B2 * | 5/2011 | Hooper et al. | 36/45 |
| 8,464,440 | B2 | 6/2013 | Hooper et al. | |
| 2003/0041395 | A1 | 3/2003 | Lin et al. | |
| 2004/0049950 | A1 | 3/2004 | Van Horne | |
| 2005/0076541 | A1 | 4/2005 | Von Blucher | |
| 2005/0210709 | A1 * | 9/2005 | Labonte | 36/89 |
| 2006/0053662 | A1 | 3/2006 | Yang | |
| 2006/0064904 | A1 | 3/2006 | Confortin et al. | |
| 2006/0075663 | A1 * | 4/2006 | Nakano | 36/109 |
| 2006/0264136 | A1 | 11/2006 | Chiantese | |
| 2007/0043630 | A1 | 2/2007 | Lyden | |
| 2007/0101615 | A1 | 5/2007 | Munns | |
| 2007/0101616 | A1 | 5/2007 | Munns | |
| 2007/0113427 | A1 | 5/2007 | Mansfield | |
| 2009/0071036 | A1 | 3/2009 | Hooper et al. | |
| 2011/0119957 | A1 | 5/2011 | Hooper et al. | |

FOREIGN PATENT DOCUMENTS

| | | |
|---|---|---|
| EP | 1095579 | 5/2001 |
| EP | 1621233 | 2/2006 |
| FR | 2770980 | 5/1999 |

OTHER PUBLICATIONS

The International Preliminary Report on Patentability mailed Mar. 25, 2010 in International Application No. PCT/US2008/075975.

Chinese Office Action together with English Translation issued Apr. 29, 2011 in Chinese Patent Application No. 200880106931.2.

Extended European Search Report dated Feb. 19, 2013 in European Application No. EP 08 83 0120.

* cited by examiner

METHOD OF MANUFACTURING AN ARTICLE OF FOOTWEAR INCLUDING A COMPOSITE UPPER

CROSS-REFERENCE TO RELATED APPLICATIONS

This application is a division of U.S. Pat. No. 8,464,440, currently U.S. application Ser. No. 13/018,596, entitled "Article of Footwear Including a Composite Upper", filed on Feb. 1, 2011, and issued on Jun. 18, 2013, which application is a continuation of U.S. Pat. No. 7,941,942, currently U.S. application Ser. No. 11/854,832, entitled "Article of Footwear Including a Composite Upper", filed on Sep. 13, 2007, and issued on May 17, 2011, which applications are hereby incorporated by reference in their entirety.

BACKGROUND

The present invention relates generally to footwear and in particular to an upper including a composite material for an article of footwear.

Articles of footwear, including composite materials, have been previously disclosed. Yang (U.S. patent number 2006/0053662) teaches a body for a skate boot. Yang teaches a sole portion, a toe portion, a heel portion and two upper portions extending from two sides of the upper portions that are made of fiber laminations constructed by multiple layers of fiber fabrics and epoxy resins by means of a hot pressing die. Yang teaches that the fibrous fabrics in the fiber laminations can be carbon fiber fabrics.

Labonte (U.S. patent number 2005/0210709) teaches a footwear having an outer shell of foam. Labonte teaches an article of footwear including an outer shell for receiving the heel, the ankle and the lateral and medial sides of the foot. Labonte teaches an outer shell comprising three layers, including a thermoformed layer, a woven layer and a film layer. Labonte teaches that the woven layer can include carbon fibers.

Both Yang and Labonte teach uppers with regions that are not covered by carbon fiber layers, which may decrease durability in these regions. Additionally, neither Yang or Labonte teach flexible composite materials that may be used for various types of footwear. Instead both Yang and Labonte teach composite materials that are stiff, which may be used with footwear such as skates that do not require much flexibility for the user.

SUMMARY

An upper including a composite material is disclosed. In one aspect, the invention provides an article of footwear, comprising: an upper including a layer of carbon fiber material; the upper comprising a toe portion, a heel portion, a middle portion, and an instep portion; and where the toe portion, the heel portion, the middle portion and the instep portion include a portion of the layer of carbon fiber material.

In another aspect, the upper is a full composite upper.

In another aspect, the upper includes a tongue portion that includes a portion of the layer of carbon fiber material.

In another aspect, the upper is made of a composite material including the layer of carbon fiber material and a flexible substrate.

In another aspect, an outer portion of the layer of carbon fiber material is associated with a coating layer.

In another aspect, the coating layer is a layer of TPU.

In another aspect, the invention provides an article of footwear, comprising: an upper including a layer of carbon fiber material; the layer of carbon fiber material being attached to a flexible substrate forming a composite material; and where the composite material is flexible.

In another aspect, the upper is lightweight.

In another aspect, the layer of carbon fiber material is attached to the flexible substrate using a hot melt adhesive.

In another aspect, the upper comprises a toe portion, a heel portion and a middle portion, wherein the toe portion, the heel portion and the middle portion each include a portion of the composite material.

In another aspect, the layer of carbon fiber material is a flexible carbon fiber weave.

In another aspect, the flexible substrate comprises canvas.

In another aspect, the invention provides a method of manufacturing a full composite upper, comprising the steps of: associating a layer of carbon fiber material with a flexible substrate to form a composite material; applying a coating layer to an outer portion of the layer of carbon fiber material; cutting the composite material into one or more portions; and assembling the one or more portions of the composite material to form an upper including the composite material.

In another aspect, the coating layer is a layer of TPU.

In another aspect, the coating layer is configured to push down exposed ends of the layer of carbon fiber material.

In another aspect, the flexible substrate is made of nylon.

In another aspect, the step of associating the layer of carbon fiber material with the flexible substrate includes a step of applying an adhesive to the layer of carbon fiber material.

In another aspect, the step of associating the layer of carbon fiber material with the flexible substrate includes a step of heating the adhesive.

In another aspect, the upper is associated with a full composite plate.

In another aspect, the upper consists of the flexible substrate and the layer of carbon fiber material and only these two materials.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
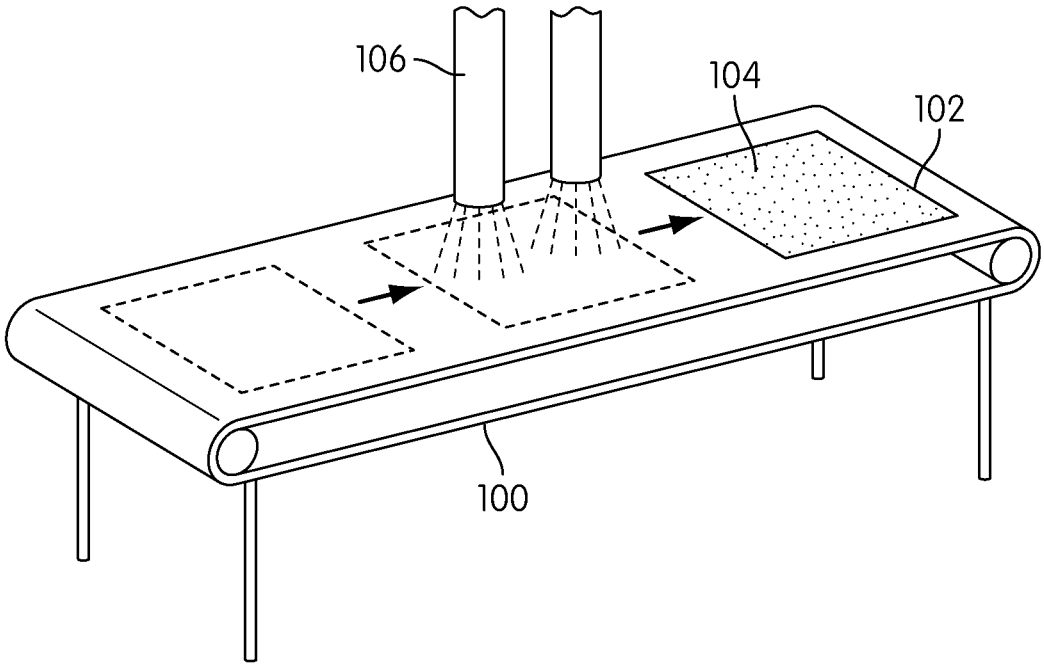
FIG. 1 is a schematic view of a preferred embodiment of a process for applying an adhesive to a carbon fiber material.

FIG. 1 is a preferred embodiment of a first step in a process for making an upper for an article of footwear. In particular, these steps are preferably used to accomplish the manufacturing of an upper including a composite material. The term "composite material" as used throughout this detailed description and in the claims, refers to any material comprising multiple material layers that are joined together. In some cases, the upper could be a full composite upper. The term "full composite upper" as used in this detailed description and in the claims, refers to any upper where a substantial entirety of the upper is made of a composite material. In other cases, a substantial majority of the upper may be made of a composite material. In other words, in these other cases, most of the upper may be made of a composite material, but not necessarily the entirety of the upper.

In some cases, an upper including a composite material may be provided with a layer of material that is durable and lightweight. Examples of these types of materials include, but are not limited to, fiber reinforced materials, including short fiber reinforced materials and continuous fiber reinforced materials, such as fiber reinforced polymers (FRPs), carbon-fiber reinforced plastic, glass fiber reinforced plastic (GRPs), as well as other materials. In a preferred embodiment, the upper may include a layer of carbon fiber material. In particular, the upper may include a layer of carbon fiber material that is made of a flexible carbon fiber weave to allow for increased flexibility of the upper.

FIGS. 1-11 are intended to illustrate a preferred process for manufacturing an upper including a composite material. It should be understood that the following process is only intended to be exemplary, and in other embodiments other methods of manufacturing the upper could be used. Each of the following steps are intended to be optional and in some cases, additional steps could be included in the manufacturing process.

Furthermore, for purposes of clarity, the following process is used to manufacture a single article of footwear. In other embodiments, this same process can be used for manufacturing additional articles of footwear, including complementary articles of footwear, comprising an article of footwear for a left foot and an article of footwear for a right foot.

Generally, this process may be used for manufacturing an upper for any type of footwear that is configured to be lightweight and flexible. Examples of various types of uppers that could be made using this process include, but are not limited to, uppers associated with football cleats, tennis shoes, running shoes, hiking shoes, soccer shoes as well as other types of footwear. In a preferred embodiment, this method may be used to make an upper for a soccer shoe, as soccer shoes may require a durable upper that is also lightweight.

In this embodiment, during a first step in a process for making an upper, layer of carbon fiber material 102 is placed on conveyor 100. During this step, adhesive 104 may be applied. In this embodiment, adhesive 104 may be applied using industrial hoses 106. In other embodiments, adhesive 104 could be applied to layer of carbon fiber material 102 using any method known in the art. For example, in other embodiments, adhesive 104 could be applied manually, rather than using a conveyor system with hoses.

Generally, adhesive 104 could be any type of adhesive. Examples of various types of adhesives that could be used include, but are not limited to natural adhesives, synthetic adhesives, drying adhesives, contact adhesives, hot melt adhesives (such as thermoplastic adhesives) and pressure sensitive adhesives. In a preferred embodiment, adhesive 104 is a hot melt adhesive.

Figure 2:
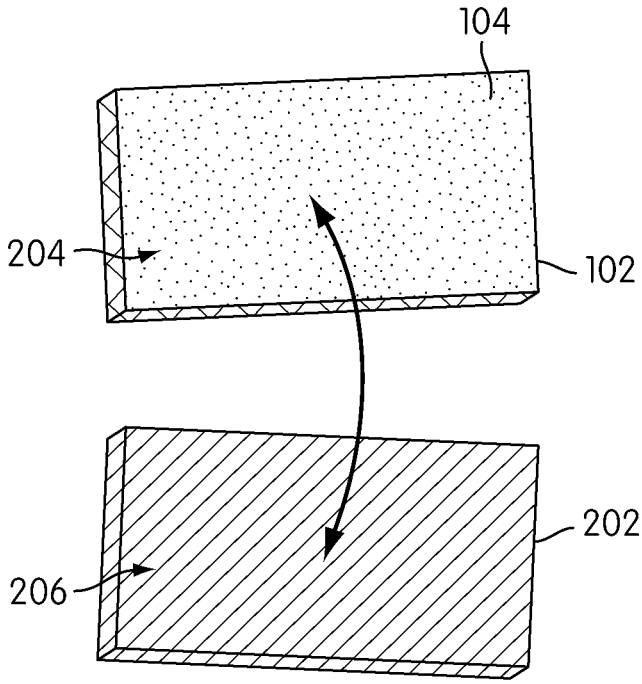
FIG. 2 is a schematic view of a preferred embodiment of a process for associating a composite material with a substrate.

Referring to FIG. 2, once adhesive 104 has been applied, layer of carbon fiber material 102 may be further associated with flexible substrate 202 to provide increased support. In this case, first side 204 of layer of carbon fiber material 102 is associated with first side 206 of flexible substrate 202. With this arrangement, flexible substrate 202 may be bonded to layer of carbon fiber material 102 using adhesive 104.

Generally, flexible substrate 202 may be any type of substrate material that allows for some flexibility. In some embodiments, traditional substrates including polyester could be used. In other embodiments, a layer of thermoplastic urethane (TPU) could be used. In a preferred embodiment, a lightweight material such as nylon may be used. In an alternate preferred embodiment, the flexible substrate includes canvas.

In the current embodiment, an adhesive is applied directly to a layer of carbon fiber material. However, in other embodiments, the adhesive could be applied to a flexible substrate. In still other embodiments, the adhesive could be applied to both the layer of carbon fiber material and to the flexible substrate.

Figure 3:
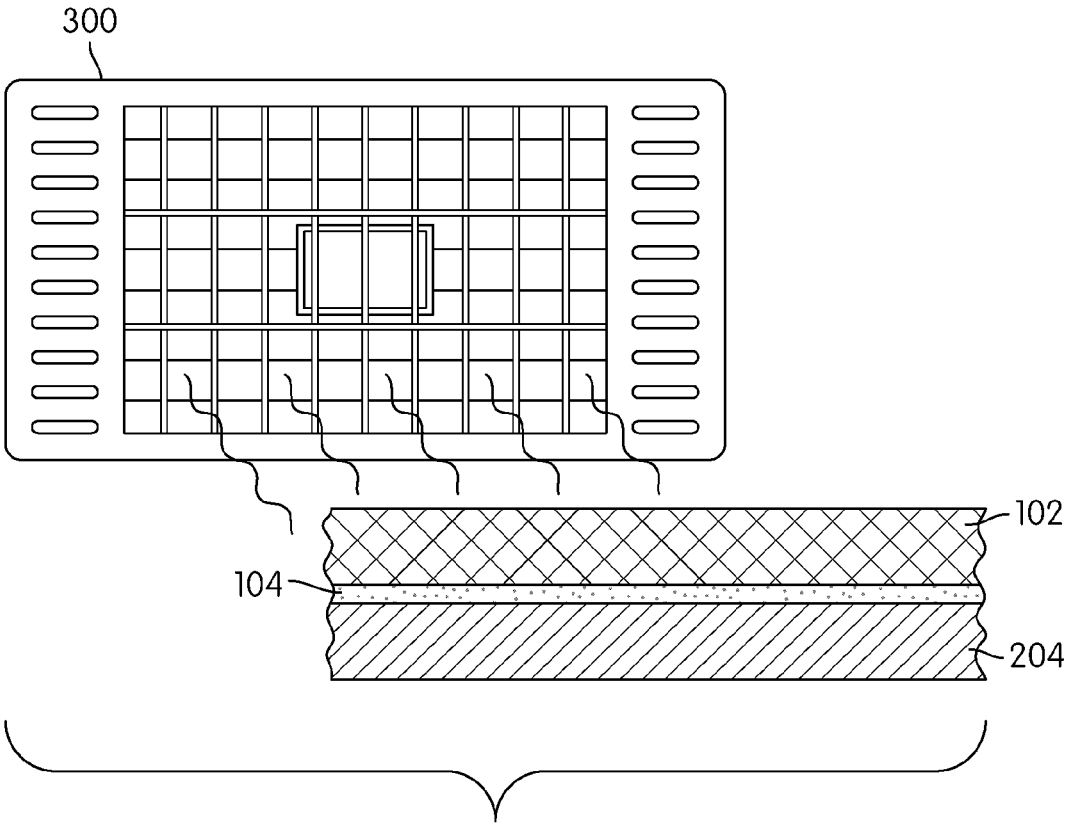
FIG. 3 is a schematic view of a preferred embodiment of a process of bonding a carbon fiber material and a substrate to form a composite material.

In some embodiments, applying heat to layer of carbon fiber material 102 and flexible substrate 202 may facilitate bonding via adhesive 104, especially if adhesive 104 is a hot melt adhesive. Referring to FIG. 3, in some cases, layer of carbon fiber material 102 and flexible substrate 202 may be exposed to industrial heater 300. In other embodiments, other methods of heating materials including adhesives that are known in the art may be used for heating layer of carbon fiber material 102, flexible substrate 202 and adhesive 104. This configuration may help melt adhesive 104 and further bond layer of carbon fiber material 102 to flexible substrate 202.

Figure 4:
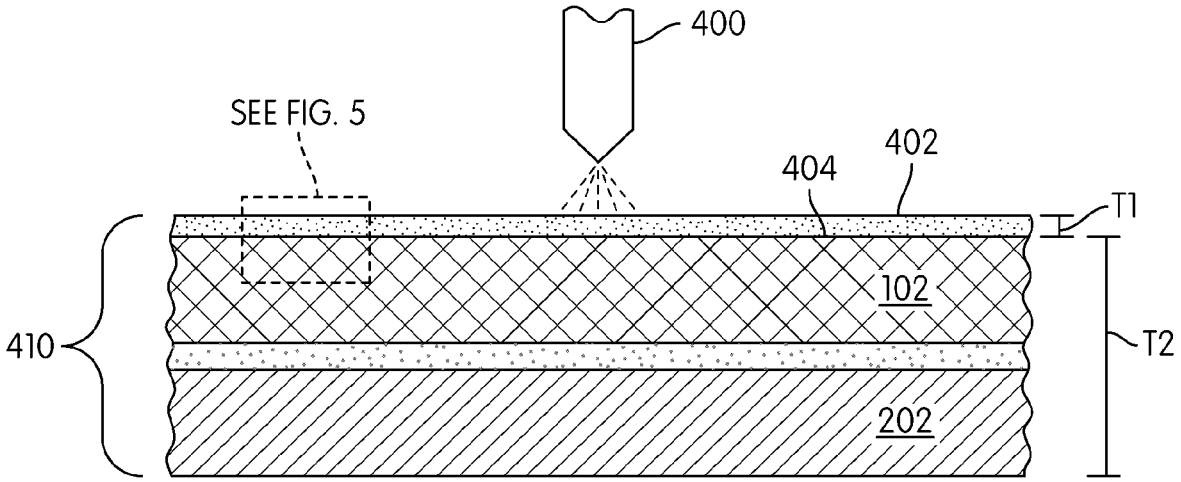
FIG. 4 is a side view of a preferred embodiment of a process for applying an outer coating to a composite material.
Figure 5:
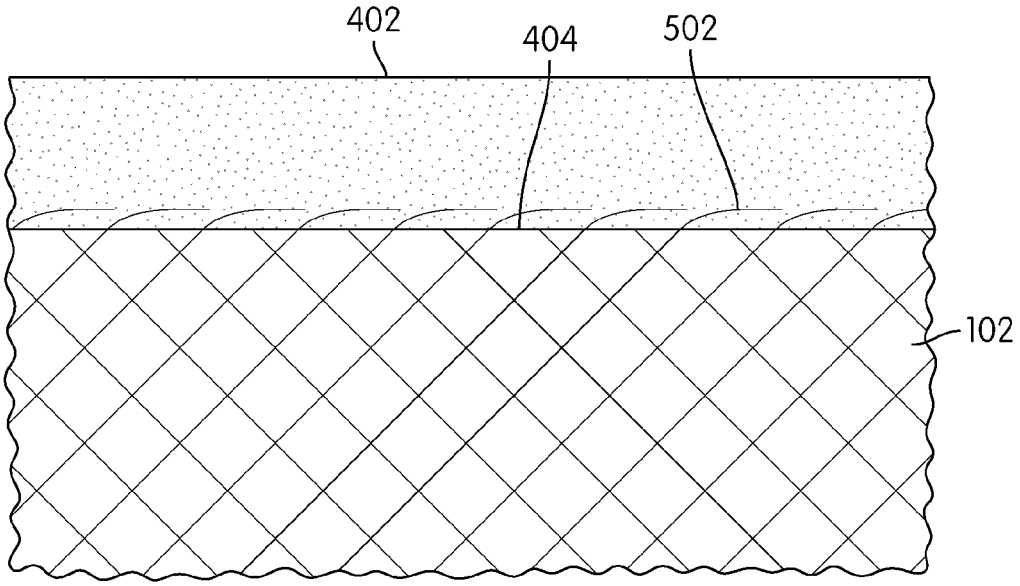
FIG. 5 is an enlarged view of a preferred embodiment of an outer coating applied to a composite material.

Referring to FIGS. 4 and 5, a protective layer may be applied to an exposed side of a layer of carbon fiber material. In this embodiment, coating layer 402 may be applied to outer portion 404 of layer of carbon fiber material 102. Generally, coating layer 402 may be applied using any known method. In a preferred embodiment, coating layer 402 may be applied using industrial hose 400. Furthermore, although only a portion of layer of carbon fiber material 102 is shown here for purposes of clarity, it should be understood that in some embodiments the entirety of outer portion 404 of layer of carbon fiber material 102 may be covered with coating layer 402.

In some embodiments, coating layer 402 may be a layer of TPU. In other embodiments, other types of coatings could be used as well. In this embodiment, coating layer 402 is thin with a first thickness T1 that is substantially smaller than second thickness T2 associated with layer of carbon fiber material 102 and flexible substrate 202. In some cases, the value of T1 may be less than one millimeter. In a preferred embodiment, the value of T1 may be approximately 0.5 millimeters. In other embodiments, however, the value of T1 could be equal to or greater than the value of T2. In other words, in some embodiments, coating layer 402 could be thicker than the combined thicknesses of layer of carbon fiber material 102 and flexible substrate 202.

This preferred arrangement may increase the durability of layer of carbon fiber material 102. Furthermore, using a coating layer may help to reduce any sharp edges associated with layer of carbon fiber material 102. In particular, in cases where layer of carbon fiber material 102 is a woven layer of carbon fibers, the weave may include exposed ends. By applying a protective layer, these exposed ends may be covered and may be made to lay down flat.

FIG. 5 is an enlarged view of a preferred embodiment of layer of carbon fiber material 102 once coating layer 402 has been applied. In this embodiment, carbon fiber material 102 includes exposed ends 502 that may initially extend outwards from outer portion 404 of layer of carbon fiber material 102. Under the pressure of coating layer 402, exposed ends 502 may be pressed down to lay flat. This preferred arrangement helps prevent exposed ends 502 from rubbing against other surfaces, and in some cases may prevent fraying of layer of carbon fiber material 102.

Referring to FIG. 4, layer of carbon fiber material 102, flexible substrate 202 and coating layer 402 may collectively form composite material 410. Although the current embodiment includes a composite material including three layers, in other embodiments a different number of layers may be used. For example, in some other embodiments, the composite material may comprise only a layer of carbon fiber material and a flexible substrate. Additionally, in still other embodiments, additional layers may also be incorporated into the composite material to provide additional protection.

Preferably, a composite material that is configured to be used with an upper should be configured to flex, bend, fold, ripple and generally deform in an elastic manner. In some embodiments, the composite material may include flexibility characteristics that are similar to other flexible materials including various natural fibers, synthetic fibers, leathers, elastically deforming plastics as well as other flexible materials. In a preferred embodiment, the composite material includes a layer of carbon fiber material that is substantially as flexible as the flexible substrate material.

Figure 6:
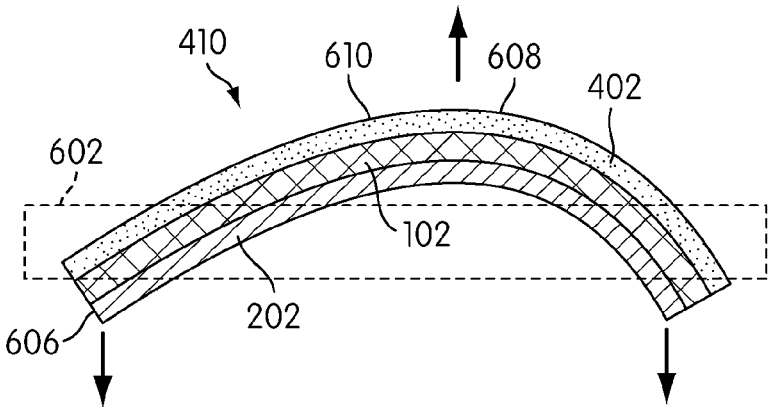
FIG. 6 is a side view of a preferred embodiment of a composite material bending.
Figure 7:
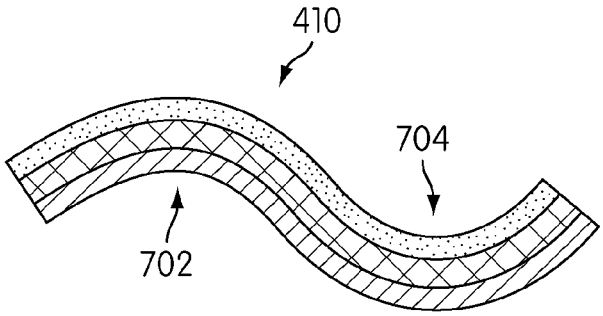
FIG. 7 is a side view of a preferred embodiment of a composite material bending.
Figure 8:
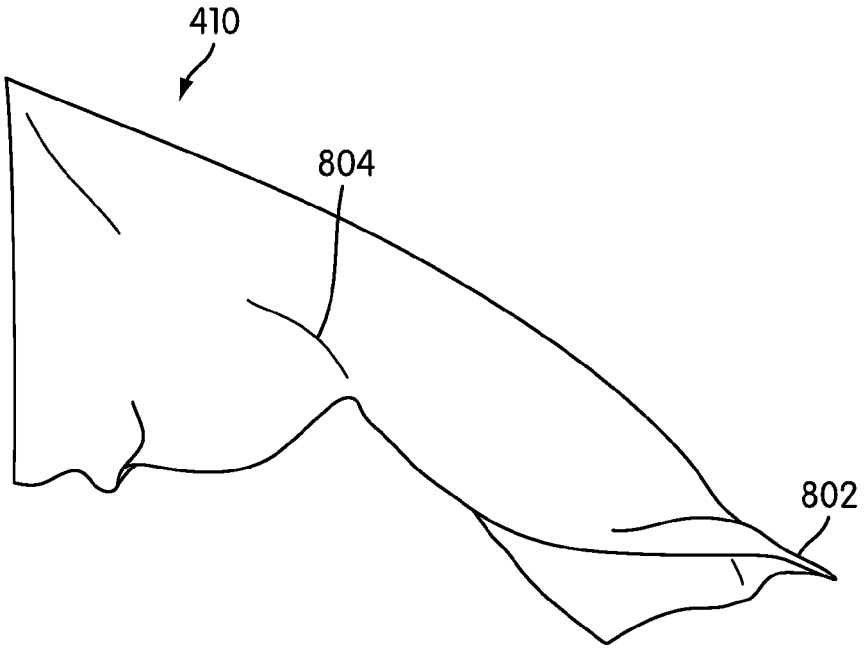
FIG. 8 is an isometric view of a preferred embodiment of a composite material folding.

FIGS. 6-8 illustrate preferred embodiments of composite material 410 undergoing various types of deformations. In FIG. 6, composite material 410 is originally oriented in flat position 602. As downwards forces are applied at ends 606 and upwards forces are applied at middle region 608, composite material 410 may undergo bending, as indicated by bent position 610. As seen in the Figure, each layer comprising composite material 410, including flexible substrate 202, layer of carbon fiber material 102 and coating layer 402, each undergo bending in a similar manner.

FIGS. 7 and 8 illustrate further examples of the bending, flexing, folding, rippling and general deformation of composite material 410. In FIG. 7, composite material 410 is undergoing an S-like bending. This arrangement illustrates the flexible nature of composite material 410, which can bend at first region 702 and second region 704, simultaneously. In FIG. 8, composite material 410 is undergoing folding, rippling, twisting and other types of deformations. In particular, third region 802 is undergoing folding. Likewise, fourth region 804 is undergoing rippling. In this example, composite material 410 is seen to behave as a flexible fabric-like material.

As seen in these Figures, composite material 410 does not permanently or plastically deform into a particular position. Furthermore, composite material 410 does not rip, break or otherwise structurally fail, regardless of the direction of the applied force. It should also be understood that these general modes of bending, folding, rippling, flexing and generally deforming of composite material 410 from an initial flat configuration are only intended to be exemplary. It should be understood that other types of deflections or deformations could also be accomplished by applying various types of forces to composite material 410.

Figure 9:
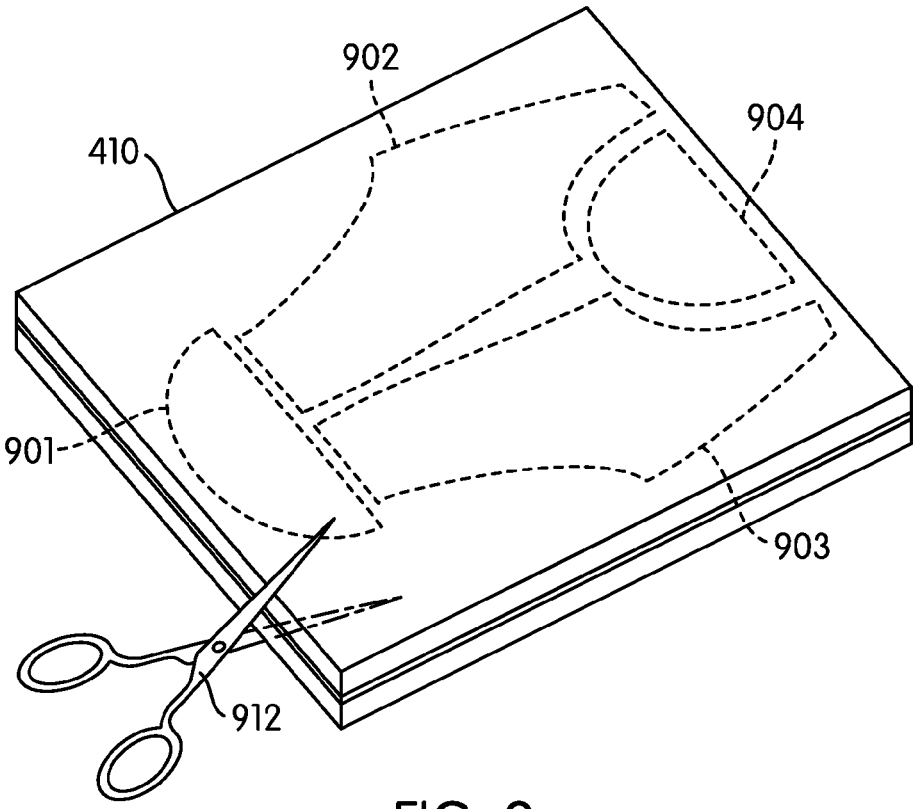
FIG. 9 is a schematic view of a preferred embodiment of a composite material being cut into multiple portions.

Referring to FIG. 9, following the application of a coating layer to the layer of carbon fiber material, composite material 410 may be configured for cutting. In some cases, one or more portions of an upper may be associated with composite material 410. In this embodiment, toe portion 901, medial portion 902, lateral portion 903 and heel portion 904 may be associated with composite material 410. In other embodiments, composite material 410 may be divided into more or less than four portions. In some cases, for example, a tongue portion may also be included.

At this point, each portion 901-904 may be cut from composite material 410. In this embodiment, each portion 901-904 may be manually cut as indicated schematically with scissors 912. Generally, each portion 901-904 may be cut from composite material 410 using any known method in the art. In some cases, each portion 901-904 may be removed using cutting dies, laser cutting techniques as well as other methods for cutting composite materials.

Figure 10:
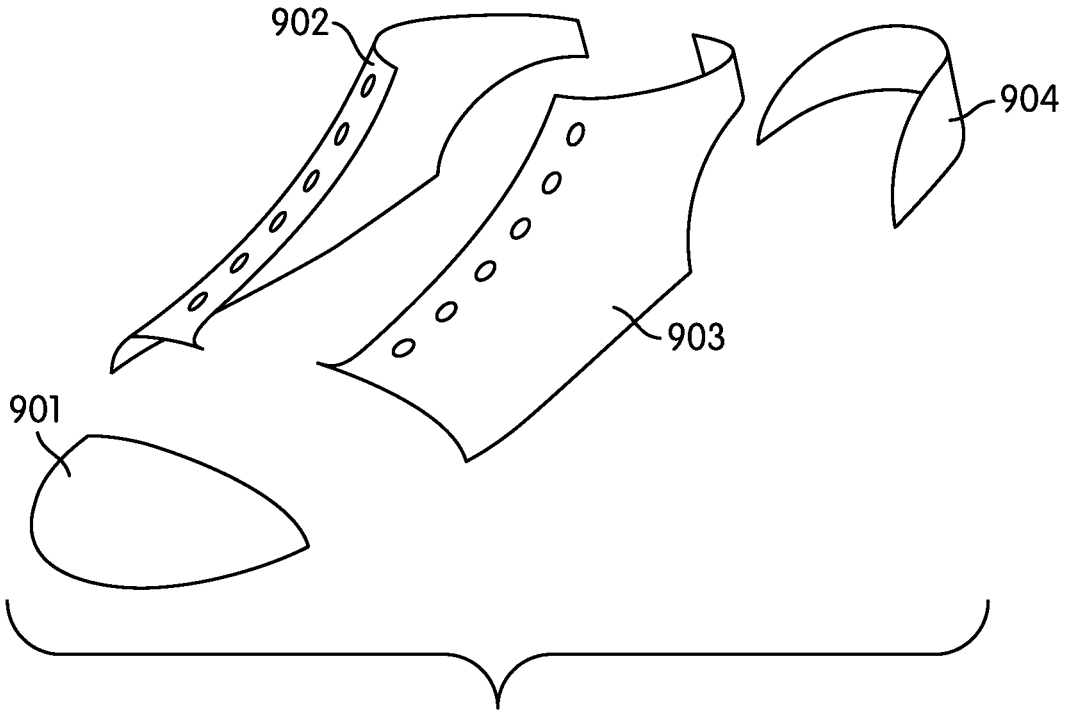
FIG. 10 is a schematic view of a preferred embodiment of a pre-assembled upper made of a composite material.
Figure 11:
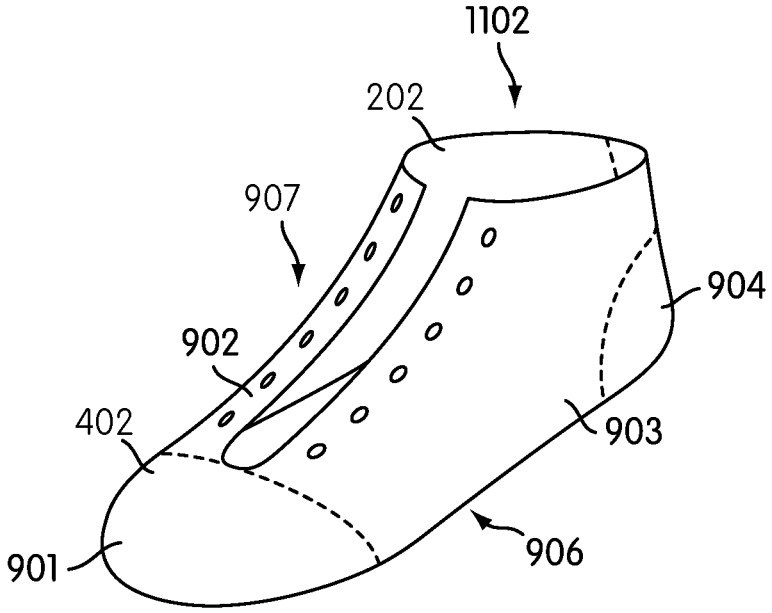
FIG. 11 is a schematic view of a preferred embodiment of an assembled upper made of a composite material.

FIGS. 10 and 11 are a preferred embodiment of steps for assembling each portion 901-904 of an upper. Initially, each portion 901-904 may be oriented in a position configured for assembly, as seen in FIG. 10. Following this, each portion 901-904 may be assembled together into upper 1102, as seen in FIG. 11. Generally, this assembly may be accomplished using any method known in the art for assembling portions of a material to form an upper. In some cases, for example, the portions may be stitched together. In other cases, the portions may be attached using an adhesive of some kind. Preferably, the method of attachment does not substantially prohibit the flexibility of the upper.

In some embodiments, each portion 901-904 may be arranged so that coating layer 402 is oriented outwardly. In other words, coating layer 402 will be exposed along the outer surface of upper 1102, while flexible substrate 202 will be disposed within the assembled upper, closest to the foot of a user. This arrangement helps to protect composite material 410, as coating layer 402 is a protective layer. Furthermore, with this arrangement, flexible substrate 202 may be disposed against the foot of a user, for increased comfort.

For clarity, in this current embodiment, each portion 902 and 903 may be referred to collectively as middle portion 906. Generally, the term "middle portion", as used throughout this detailed description and in the Figures, refers to any portion of an upper disposed between a toe portion and a heel portion. In some cases, middle portion 906 may further comprise instep portion 907.

In the current embodiment, upper 1102 is a full composite upper. In other words, each portion 901, 904 and 906 is made entirely of composite material 410, including a layer of carbon fiber material. In other embodiments, however, some portions of upper 1102 could comprise other materials as well. In a preferred embodiment, each portion 901, 904 and 906 includes a portion of layer of carbon fiber material 102.

Additionally, in a preferred embodiment, instep portion 907 may include a portion of layer of carbon fiber material 102.

Figure 12:
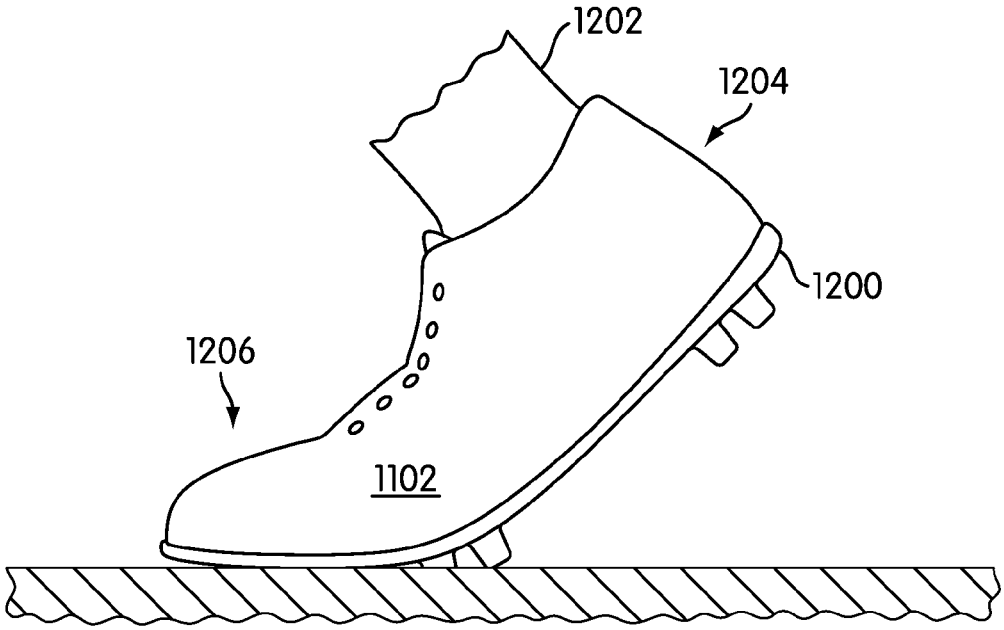
FIG. 12 is a schematic view of a preferred embodiment of an upper made of a composite material undergoing bending.

FIG. 12 is a preferred embodiment of article of footwear 1200, including upper 1102, undergoing bending as user 1202 takes a step forward. Because upper 1102 is made of a composite material, upper 1102 is configured to bend easily, without any tearing, ripping, or other structural failures occurring. Furthermore, upper 1102 is configured to undergo extreme types of bending, as occurs in this embodiment.

The current embodiment is only intended to be exemplary, and in other embodiments it should be understood that upper 1102 could also undergo various other types of deflections or deformations. Generally, one or more regions of upper 1102 may be bent, flexed, twisted, folded or otherwise deformed. These provisions allow for increased performance for user 1202, as a rigid upper could limit various types of movements including running, kicking or other movements associated with use of article of footwear 1200.

Traditionally, designing uppers has required the manufacturer to compromise between durability and weight when choosing suitable materials. For example, materials that are durable and that help to reduce the tendency for injury are often heavier and may limit performance by weighing down the user. In the current design, however, a composite material can be constructed as a lightweight material, since carbon fibers are known to be both durable and lightweight. Additionally, by using a flexible carbon fiber weave, as previously discussed, the composite material is not too rigid to be used as an upper material.

Figure 13:
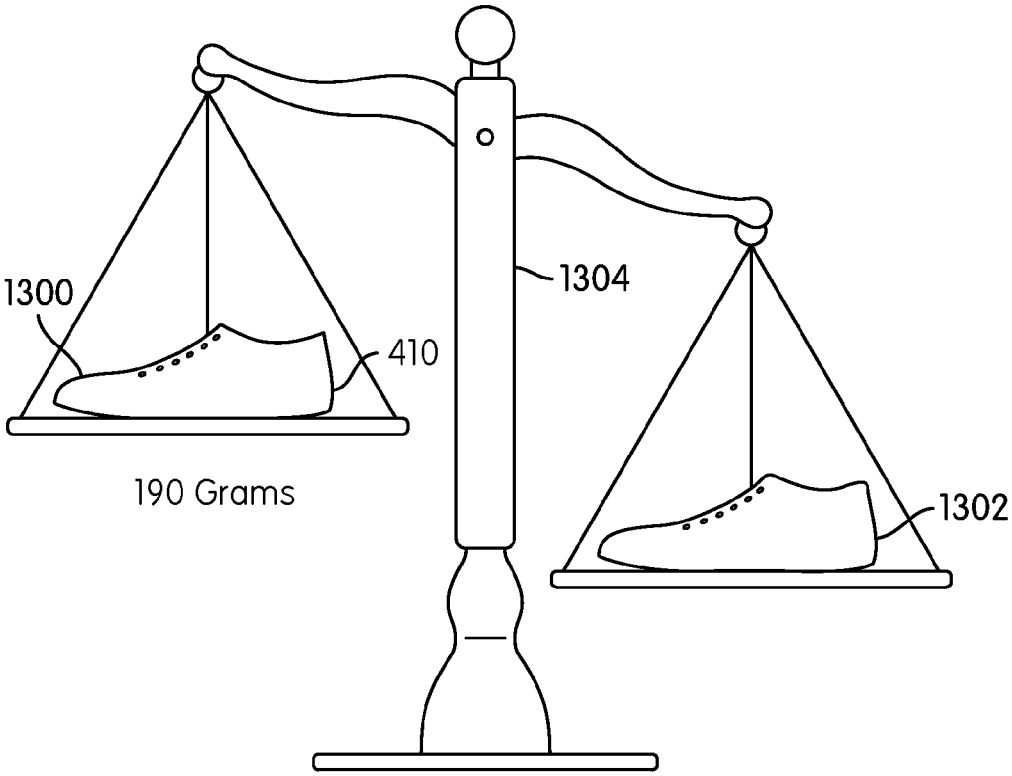
FIG. 13 is a schematic view of a preferred embodiment of an upper made of a composite material being weighed.
Figure 14:
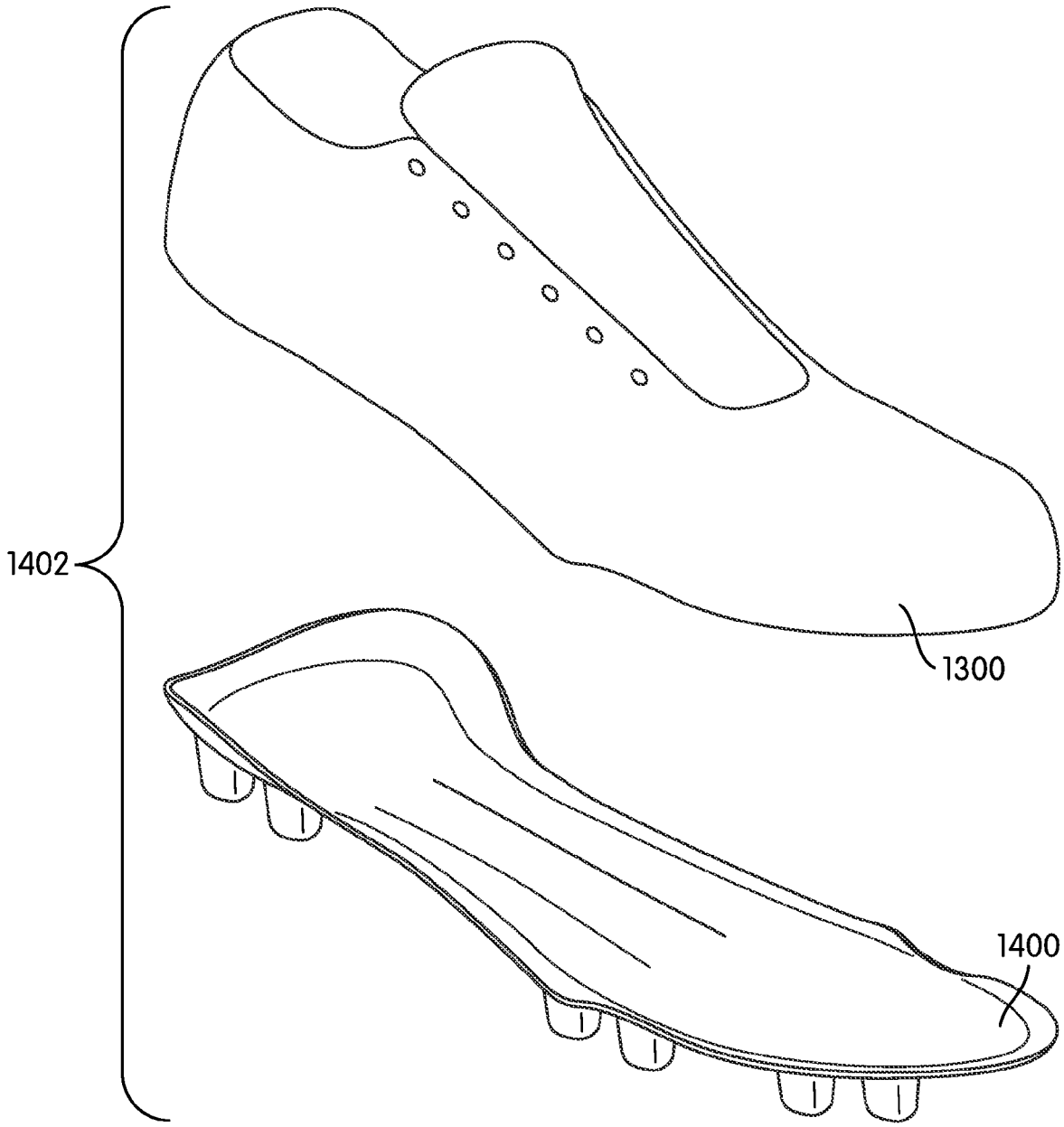
FIG. 14 is a schematic view of a preferred embodiment of an upper made of a composite material being assembled with a full composite plate.

FIG. 13 is a schematic view of a preferred embodiment of full composite upper 1300 and standard upper 1302. In this case, the entirety of upper 1102 is made of composite material 410, including a layer of carbon fiber material, a flexible substrate, and a thin coating layer. Standard upper 1302, however, has been constructed using traditional upper materials, which include, but are not limited to, leathers, plastics, canvas as well as natural and synthetic fabrics. As indicated using scale 1304, standard upper 1302 is generally heavier than full composite upper 1300. In a preferred embodiment, the weight of full composite upper 1300, associated with a size 9 shoe for men, is approximately 190 grams or less. This weight is substantially less than the weight of uppers associated with a size 9 shoe for men that are constructed using traditional materials.

Although the current embodiment discusses a size 9 shoe for men, the weight of a full composite upper having a different size will also be substantially less than an upper constructed of traditional materials having the same size. In other words, a size 12 full composite upper will have a weight substantially less than the weight of a size 12 upper constructed of traditional materials. In some cases, the relative reduction in weight will be similar for each upper size. In other words, the ratio of the weight of a full composite upper over the weight of an upper constructed of traditional materials may be approximately the same for all upper sizes. In other cases, the value of this ratio may fall within a fixed range of ratio values.

Furthermore, the examples discussed here are not intended to limit this weight reducing feature to uppers associated with shoes for men. Generally, full composite uppers constructed for women and children may also weigh less than uppers of similar sizes constructed from traditional materials. Furthermore, the relative reduction in weight of the uppers between a full composite upper and an upper made of traditional materials may be similar for each upper size in both shoes for children and shoes for women.

Finally, it should be understood that while these examples discuss the preferred embodiment of a full composite upper, in other cases, the weight of an upper including any portion of a layer of carbon fiber material may be reduced over an upper having a similar size that is constructed of traditional materials.

In some embodiments, a full composite upper may be associated with a full composite plate. In an exemplary embodiment, the full length plate may be similar to one of the full length plates disclosed in U.S. Ser. No. 11/458,044, filed on Jul. 17, 2006, which is incorporated herein by reference in its entirety.

In this current embodiment, full composite upper 1300 may be associated with full composite plate 1400. Full composite upper 1300 may be attached to full composite plate 1400 to form article of footwear 1402 that is made primarily of full composite materials. Any known method of attaching composite materials may be used for attaching full composite upper 1300 to full composite plate 1400. Using this preferred arrangement, article of footwear 1402 may be extremely lightweight when compared to traditional articles of footwear while still maintaining increased durability and support for the user.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of manufacturing an article of footwear, comprising the steps of:

associating a woven layer of carbon fiber material with a flexible substrate to form a flexible composite material;

applying a coating layer to an outer portion of the woven layer of carbon fiber material;

the flexible composite material having a sheet-like configuration comprised of the flexible substrate, the woven layer of carbon fiber material and the coating layer, wherein the sheet-like configuration of the flexible composite material bends simultaneously in opposite directions at two adjacent and contiguous regions;

cutting the sheet of flexible composite material into two or more portions;

assembling the two or more portions of the flexible composite material to form an upper for the article of footwear, the upper including the flexible composite material, and wherein the coating layer of the flexible composite material forms a majority of an outer surface of the upper;

wherein the outer portion of the woven layer of carbon fiber material further includes a plurality of exposed ends; and wherein the coating layer pushes down at least a portion of the plurality of exposed ends.

2. The method according to claim 1, wherein the step of applying the coating layer further comprises applying the coating layer directly onto the outer portion of the woven layer of carbon fiber material via a hose.

3. The method according to claim 1, wherein the flexible composite material does not permanently or plastically deform.

4. The method according to claim 3, wherein the flexible composite material allows for increased flexibility in the upper.

5. The method according to claim 1, wherein the coating layer is applied to a thickness of approximately 0.5 millimeters.

6. The method according to claim 1, wherein the coating layer is a layer of TPU.

7. The method according to claim 1, further comprising attaching the upper to a full composite plate to form the article of footwear.

8. The method according to claim 1, wherein the upper is formed as a full composite upper having at least a portion of the woven layer of carbon fiber material extending through a toe portion, a heel portion, and a middle portion of the article of footwear.

9. A method of manufacturing an upper for an article of footwear, comprising the steps of:

joining a layer of woven carbon fiber material with a flexible substrate along a first side of the layer of woven carbon fiber material to form a flexible composite material;

applying a coating layer to a second side of the layer of woven carbon fiber material, the second side being disposed opposite to the first side;

the flexible composite material having an initially flat sheet-like configuration that bends, folds, and deforms in a non-permanent manner;

cutting two or more portions from the flat sheet of the flexible composite material, each of the two or more portions of the flexible composite material including the flexible substrate disposed on the first side of the woven carbon fiber material and the coating layer disposed on the second side of the woven carbon fiber material;

assembling the two or more portions of the flexible composite material to form the upper including the flexible composite material; and wherein the coating layer disposed on the second side of the woven carbon fiber material forms a majority of an outer surface of the upper.

10. The method according to claim 9, wherein the coating layer is a layer of TPU.

11. The method according to claim 9, wherein the coating layer is configured to push down a plurality of exposed ends of the layer of woven carbon fiber material.

12. The method according to claim 9, wherein the step of applying the coating layer further comprises applying the coating layer directly onto the second side of the layer of woven carbon fiber material via a hose.

13. The method according to claim 9, wherein the flexible substrate is made of nylon.

14. The method according to claim 9, wherein the step of joining the layer of carbon fiber material with the flexible substrate includes a step of applying an adhesive to the first side of the layer of woven carbon fiber material.

15. The method according to claim 14, wherein the step of joining the layer of woven carbon fiber material with the flexible substrate includes a step of heating the adhesive.

16. The method according to claim 9, further comprising associating the upper with a full composite plate to form the article of footwear.

17. The method according to claim 9, wherein the upper consists essentially of the flexible substrate, the layer of woven carbon fiber material, and the coating layer.

18. A method of manufacturing a full composite upper for an article of footwear, comprising the steps of:

associating a layer of carbon fiber material made of a flexible fiber weave with a flexible substrate to form a flexible composite material;

applying a thin outer coating layer to an outer portion of the carbon fiber material;

the flexible composite material having a sheet-like configuration comprised of the flexible substrate, the flexible fiber weave of carbon fiber material and the thin outer coating layer, wherein the sheet-like configuration of the flexible composite material bends simultaneously in opposite directions at two adjacent and contiguous regions;

cutting the sheet of flexible composite material into at least a toe portion, a heel portion, and a middle portion, wherein each of the toe portion, the heel portion, and the middle portion includes a portion of the layer of carbon fiber material;

assembling the toe portion, the heel portion, and the middle portion of the flexible composite material together to form the full composite upper for the article of footwear, wherein the thin outer coating layer applied onto the outer portion of the carbon fiber material forms a majority of an outer surface of the upper; and wherein the full composite upper consists essentially of the flexible substrate, the layer of carbon fiber material, and the thin outer coating layer.

19. The method according to claim 18, further comprising associating the full composite upper with a full composite plate to form the article of footwear.

20. The method according to claim 18, wherein the step of applying a thin outer coating layer comprises applying a layer of TPU to cover a plurality of exposed ends of the flexible fiber weave.

* * * * *